US009632452B2

(12) United States Patent
Ohkubo et al.

(10) Patent No.: US 9,632,452 B2
(45) Date of Patent: Apr. 25, 2017

(54) IMAGE FORMING APPARATUS OPERABLE IN WRITING POSITION CORRECTION MODE

(71) Applicant: CANON KABUSHIKI KAISHA, Tokyo (JP)

(72) Inventors: Yuji Ohkubo, Abiko (JP); Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/011,316

(22) Filed: Jan. 29, 2016

(65) Prior Publication Data

US 2016/0147175 A1 May 26, 2016

Related U.S. Application Data

(63) Continuation of application No. PCT/JP2014/070800, filed on Jul. 31, 2014.

(30) Foreign Application Priority Data

Jul. 31, 2013 (JP) ..... 2013-159921

(51) Int. Cl.
*G03G 15/01* (2006.01)
*G03G 15/08* (2006.01)
*G03G 15/00* (2006.01)

(52) U.S. Cl.
CPC ..... *G03G 15/0824* (2013.01); *G03G 15/0189* (2013.01); *G03G 15/5058* (2013.01); *G03G 2215/0161* (2013.01)

(58) Field of Classification Search
CPC ..... G03G 15/5033; G03G 15/5041; G03G 2215/0161; G03G 2215/0158
(Continued)

(56) References Cited

U.S. PATENT DOCUMENTS 9,098,041 B2 8/2015 Suzuki
2013/0064564 A1* 3/2013 Kubota ..... G03G 15/0189 399/72
2013/0164006 A1 6/2013 Suzuki

FOREIGN PATENT DOCUMENTS

EP 2 388 652 A2 11/2011
JP 2006-189625 A 7/2006
(Continued)

OTHER PUBLICATIONS

Extended European Search Report dated Feb. 17, 2017, in European Patent Application No. 14832090.6.

*Primary Examiner* — Hoang Ngo
(74) *Attorney, Agent, or Firm* — Fitzpatrick, Cella, Harper & Scinto

(57) ABSTRACT

Precise correction of a position of a toner image formed by an image forming station can be accomplished in a device using two-component developer. An electrostatic latent image for forming a color misregistration correction pattern for color misregistration correcting includes a first latent image pattern and a second latent image pattern at a position downstream of the first latent image pattern with respect to the moving direction of the electrostatic latent image. The toner image resulting from the development of the first latent image pattern has a width, measured in the image moving direction, which is greater than that of the toner image resulting from the development of a latent image pattern alone, which is the same as the first latent image pattern, or the toner image resulting from the development of the first latent image pattern has an image density at a downstream end portion with respect to the moving direction, which density is higher than that of the toner image resulting from the development of the latent image pattern alone, which is the same as the first latent image pattern.

8 Claims, 13 Drawing Sheets

(58) Field of Classification Search
USPC ..... 399/49, 72, 301, 333
See application file for complete search history.

(56) References Cited

FOREIGN PATENT DOCUMENTS

| | | | |
|---|---|---|---|
| JP | 2007-078778 | A | 3/2007 |
| JP | 2013-061505 | A | 4/2013 |
| JP | 2013-134468 | A | 7/2013 |

* cited by examiner

IMAGE FORMING APPARATUS OPERABLE IN WRITING POSITION CORRECTION MODE

FIELD OF THE INVENTION

The present invention relates to an image forming apparatus such as a copying machine, a printer, a facsimile machine or a multifunction machine having the functions of them, more particularly to formation of a toner image for image correction.

BACKGROUND ART

In an image forming apparatus such as a digital color copying machine, for example, in which different color images are overlaid on one recording material, a positional deviation, that is, a color misregistration, is a problem. In order to correct the positional deviation (color misregistration), it is important to detect, with high precision by an optical sensor, a color misregistration correction pattern (toner image for correction) in the form of rectangular images formed on an image bearing member by image forming stations.

However, simply forming the rectangular color misregistration correction pattern results in deterioration of a detection accuracy attributable to edge effect. In view of this, a means is proposed in which line patterns are formed before and after the color misregistration correction pattern with spaces so that an increase of a toner image density at the end portions of the color misregistration correction pattern attributable to the edge effect is suppressed (Japanese Laid-open Patent Application 2006-189625).

Here, with the structure disclosed in the Japanese publication, the developer used there is a developer comprising magnetic toner. On the other hand, in the case of using developer containing non-magnetic toner and magnetic carrier particles, there is a likelihood that a density at an end portion of the color misregistration correction pattern may decrease.

That is, in the developing device using the two component developer, magnetic chains including the toner and the carrier are formed along magnetic flux lines provided by a magnet roller disposed in a developing sleeve, and the toner is supplied to the position of an electrostatic latent image on the photosensitive drum from the magnetic chains, thus developing the electrostatic latent image. At this time, a so-called counter charge phenomenon occurs in which the toner (negative charging) once transferred onto the photosensitive drum from the magnetic chain (positive charging) formed on the developing sleeve by the carrier returns to the magnetic chain. Generally, a peripheral speed of the developing sleeve is made higher than the peripheral speed of the photosensitive drum to enhance the development property.

In such a case, at a rear end of the electrostatic latent image (with respect to a sub-scan direction) which is a boundary between an image formation region and a non-image formation region, the magnetic chain having passed an electric field region with which the toner does not develop the image passes. In this region, the toner is returned to the magnetic chain with the result of the decrease of the amount of the toner on the photosensitive drum, that is, the toner amount decreases at the rear end of the toner image.

In this manner, when the sensor detects the rear end of the color misregistration correction pattern having the decreased density, the detected position of the color misregistration correction pattern involves an error, with the possible result of incapability of satisfactory color misregistration correction (correction of the position of the toner image formed by the image forming station).

SUMMARY OF THE INVENTION

Problem to be Solved by the Invention

Under the circumstances, the present invention provides a structure with which the correction of the position of the toner image formed by an image forming station can be effected with high precision, in the device using two-component developer.

Means for Solving the Problem

According to an aspect of the present invention, there is provided an image forming apparatus comprising a plurality of image forming stations configured to form respective toner images; said image forming station each including a rotatable image bearing member, a latent image forming device configured to form an electrostatic latent image on said image bearing member, and a developing device configured to develop the electrostatic latent image formed on said image bearing member, said developing device including a developer carrying member configured to carry a developer comprising toner and a carrier and movable in the same direction at a position where said developer carrying member is opposed to said image bearing member; a toner sensor configured to detect a toner image for registration correction of images formed by said image forming stations: a controller capable of executing a operation in a mode for correcting a writing position of the images formed by said image forming stations on the basis of a result of detection of the toner images for the registration correction by said toner sensor, wherein in the operation in the mode, said controller effects the control such that in forming a first latent image pattern which is a latent image for the toner image for the registration correction, a second latent image pattern is formed at least in an upstream side of the first latent image pattern except for the downstream side thereof with respect to a moving direction of the image, and said controller controls a formation position of the second latent image pattern such that the toner image resulting from the development of the first latent image pattern has a width, measured in the image moving direction, which is larger than that of the toner image resulting from the development of a latent image pattern alone which is the same as the first latent image pattern, or the toner image resulting from the development of the first latent image pattern has an image density in downstream end portion with respect to the moving direction, which density is higher than that of the toner image resulting from the development of the latent image pattern alone which is the same as the first latent image pattern.

According to another aspect of the present invention, there is provided an image forming apparatus comprising a plurality of image forming stations configured to form respective toner images; said image forming station each including a rotatable image bearing member, a latent image forming device configured to form an electrostatic latent image on said image bearing member, and a developing device configured to develop the electrostatic latent image formed on said image bearing member, said developing device including a developer carrying member configured to carry a developer comprising toner and a carrier and movable in the same direction at a position where said developer carrying member is opposed to said image bearing member; a toner sensor configured to detect a toner image for registration correction of images formed by said image forming stations: a controller capable of executing a operation in a mode for correcting a writing position of the images formed by said image forming stations on the basis of a result of detection of the toner images for the registration correction by said toner sensor, wherein in the operation in the mode, said controller effects the control such that in forming a first latent image pattern which is a latent image for the toner image for the registration correction, a second latent image pattern is formed in a upstream side of the first latent image pattern with respect to a moving direction of the image, and said controller controls a formation position of the second latent image pattern such that the toner image resulting from the development of the first latent image pattern has a width, measured in the image moving direction, which is larger than that of the toner image resulting from the development of a latent image pattern alone which is the same as the first latent image pattern, or the toner image resulting from the development of the first latent image pattern has an image density in downstream end portion with respect to the moving direction, which density is higher than that of the toner image resulting from the development of the latent image pattern alone which is the same as the first latent image pattern, and wherein said controller controls a formation position of the second latent image pattern such that a difference between the width, measured in the image moving direction, of the toner image resulting from the development of the first latent image pattern and a width of the first latent image pattern is not more than 200 μm.

Effect of Invention

According to the present invention, the correction of the position of the toner image formed by the image forming station can be effected with high precision, in the device using the two-component developer.

Figure 9:
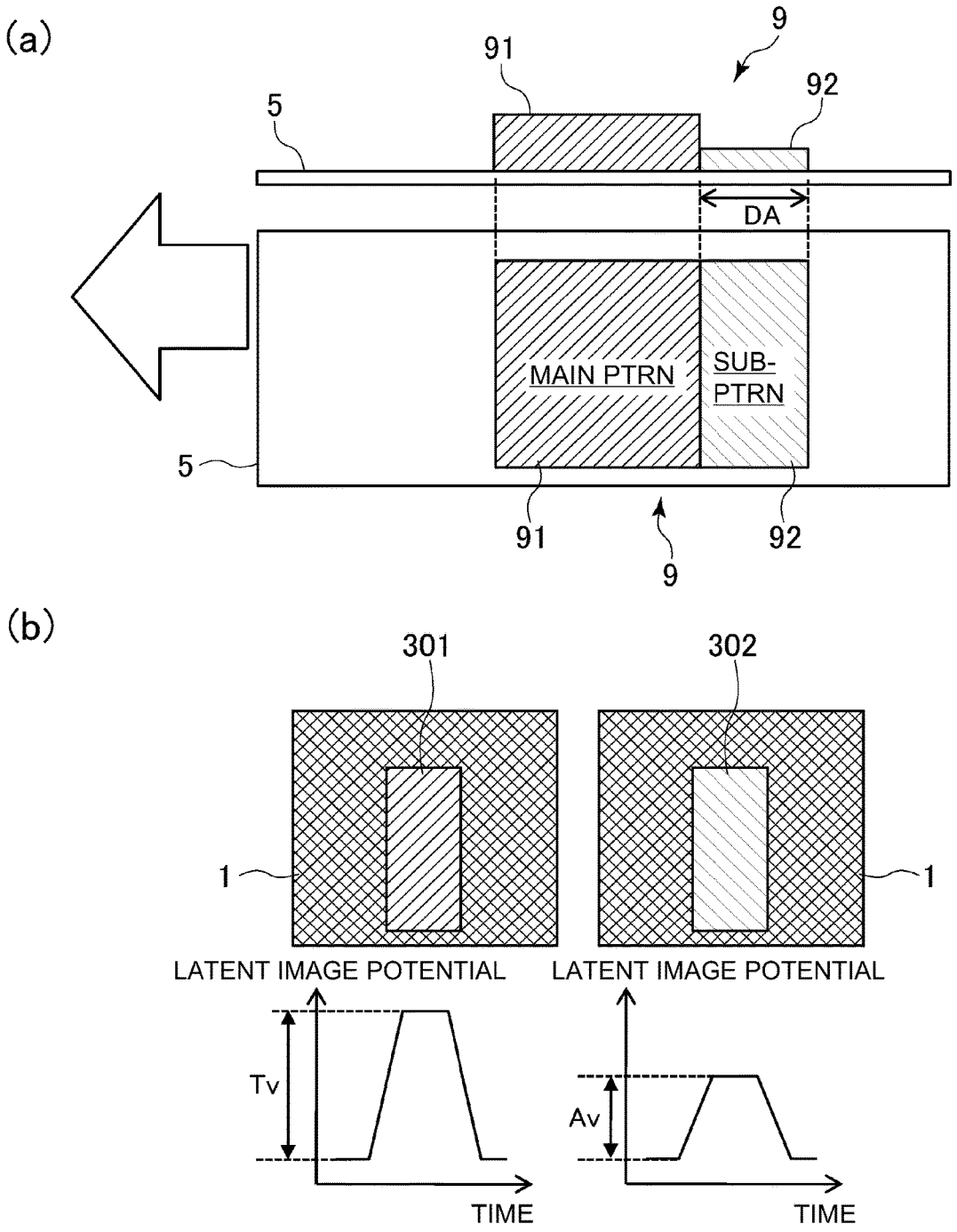

Part (a) of FIG. 9 is a sectional view and a top plan view showing a state in which a color misregistration correction pattern of this embodiment is formed on an intermediary transfer belt, and part (b) shows a main pattern and a sub-pattern, and a potential for an electrostatic latent image for forming them.

Figure 10:
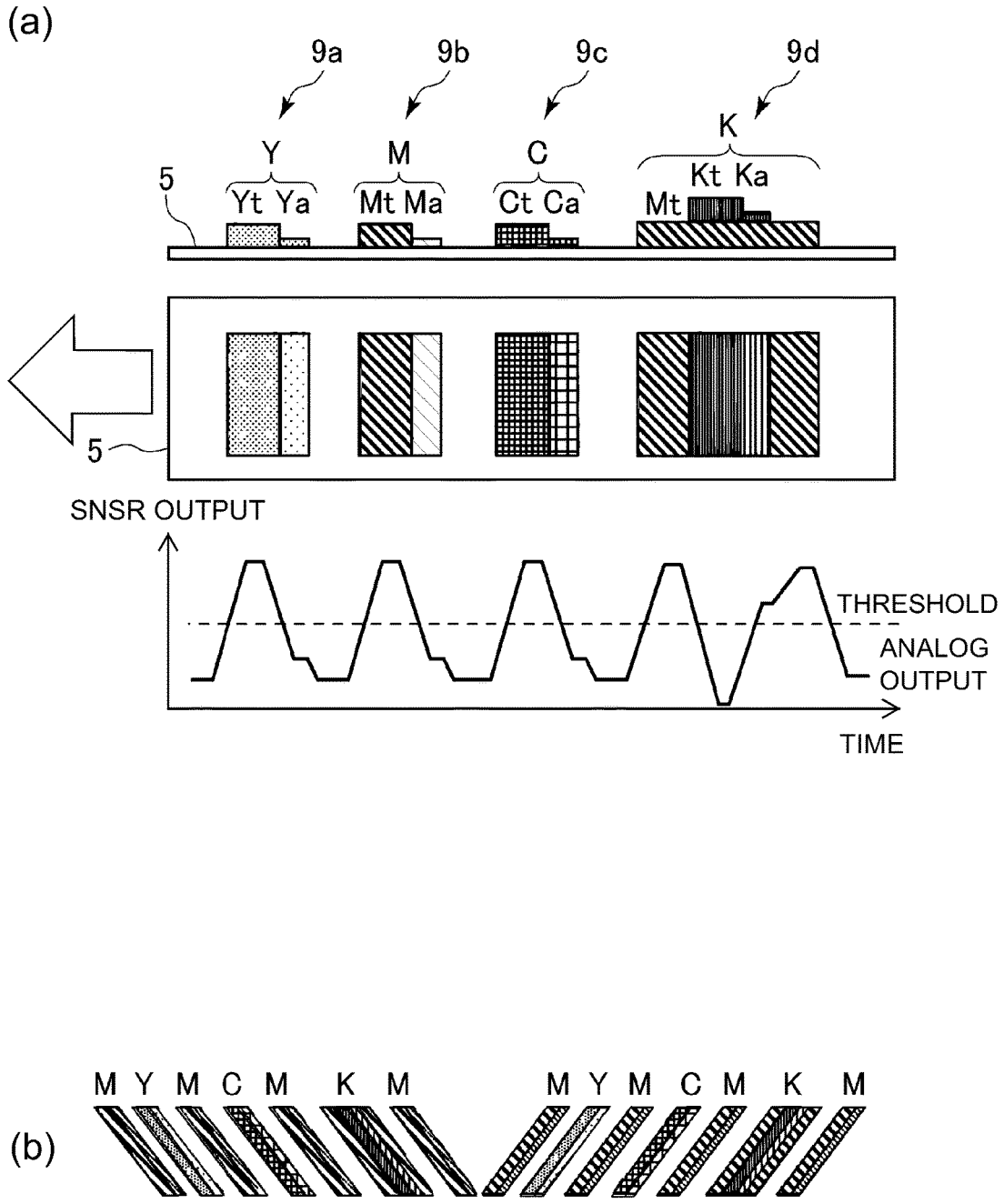

Part (a) of FIG. 10 is a sectional view and a top plan view schematically showing a color misregistration correction pattern for each color formed on the intermediary transfer belt, and the sensor output signal when each pattern is detected, and part (b) is a top plan view schematically showing a configuration of the color misregistration correction pattern of each color.

Figure 11:
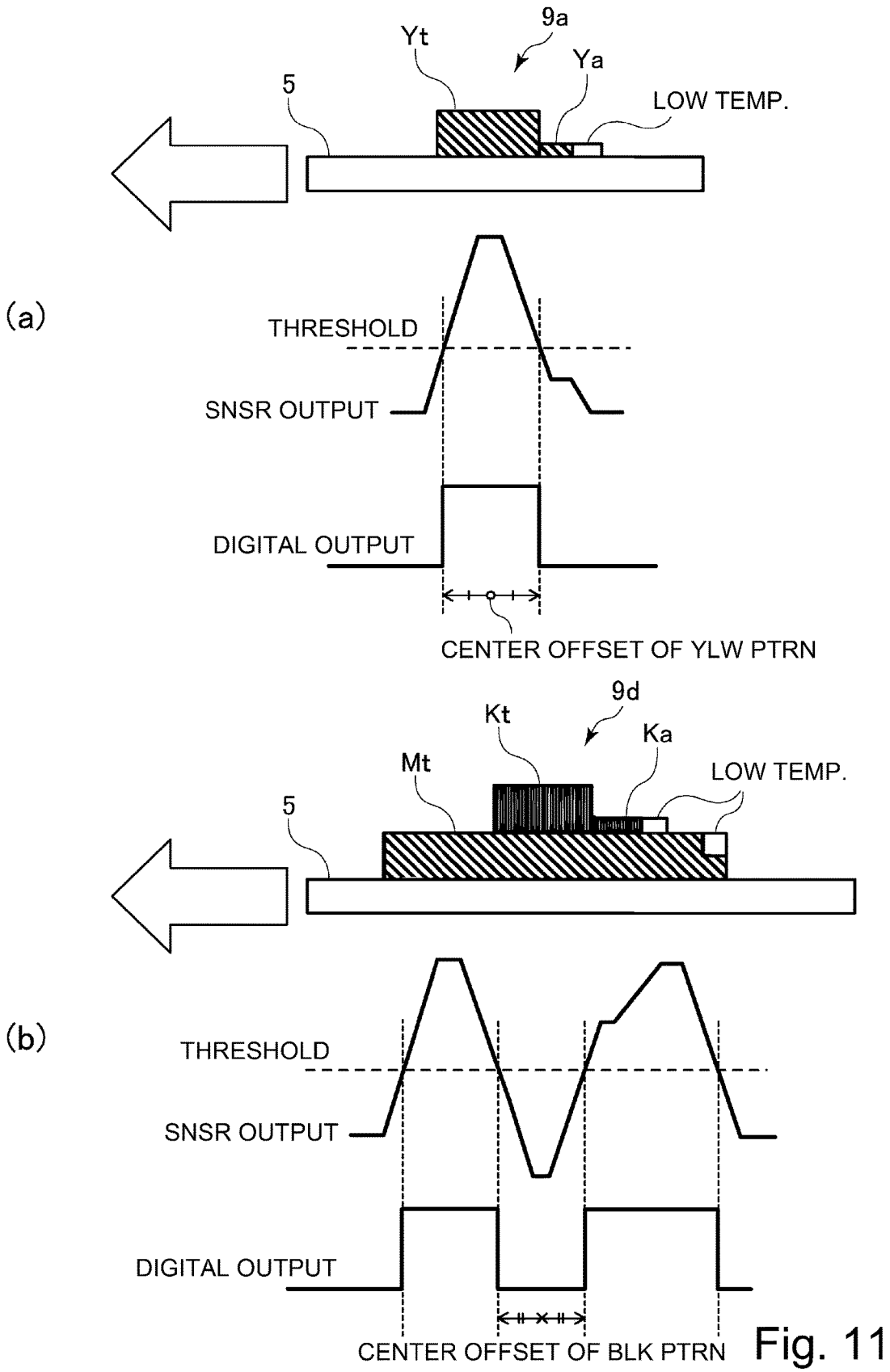

Part (a) of FIG. 11 is a sectional view schematically showing the color misregistration correction pattern of a chromatic color, and part (b) is a sectional view schematically showing the color misregistration correction pattern of black, a sensor output signal when it is detected, and a binarized signal.

Figure 12:
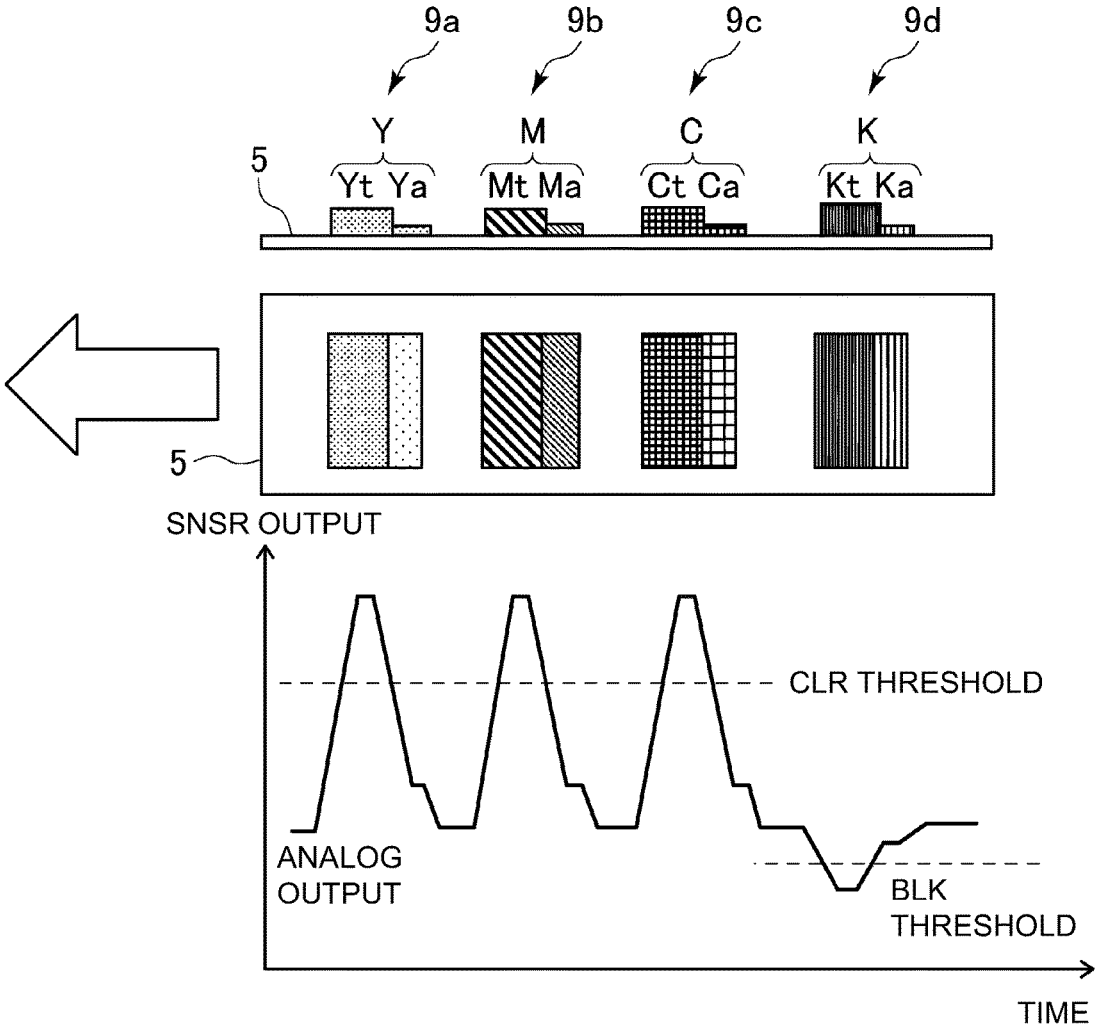

FIG. 12 is a sectional view and a top plan view schematically showing the color misregistration correction pattern of each color formed on the intermediary transfer belt in a second embodiment of the present invention, and a sensor output signal when each pattern is detected.

Figure 13:
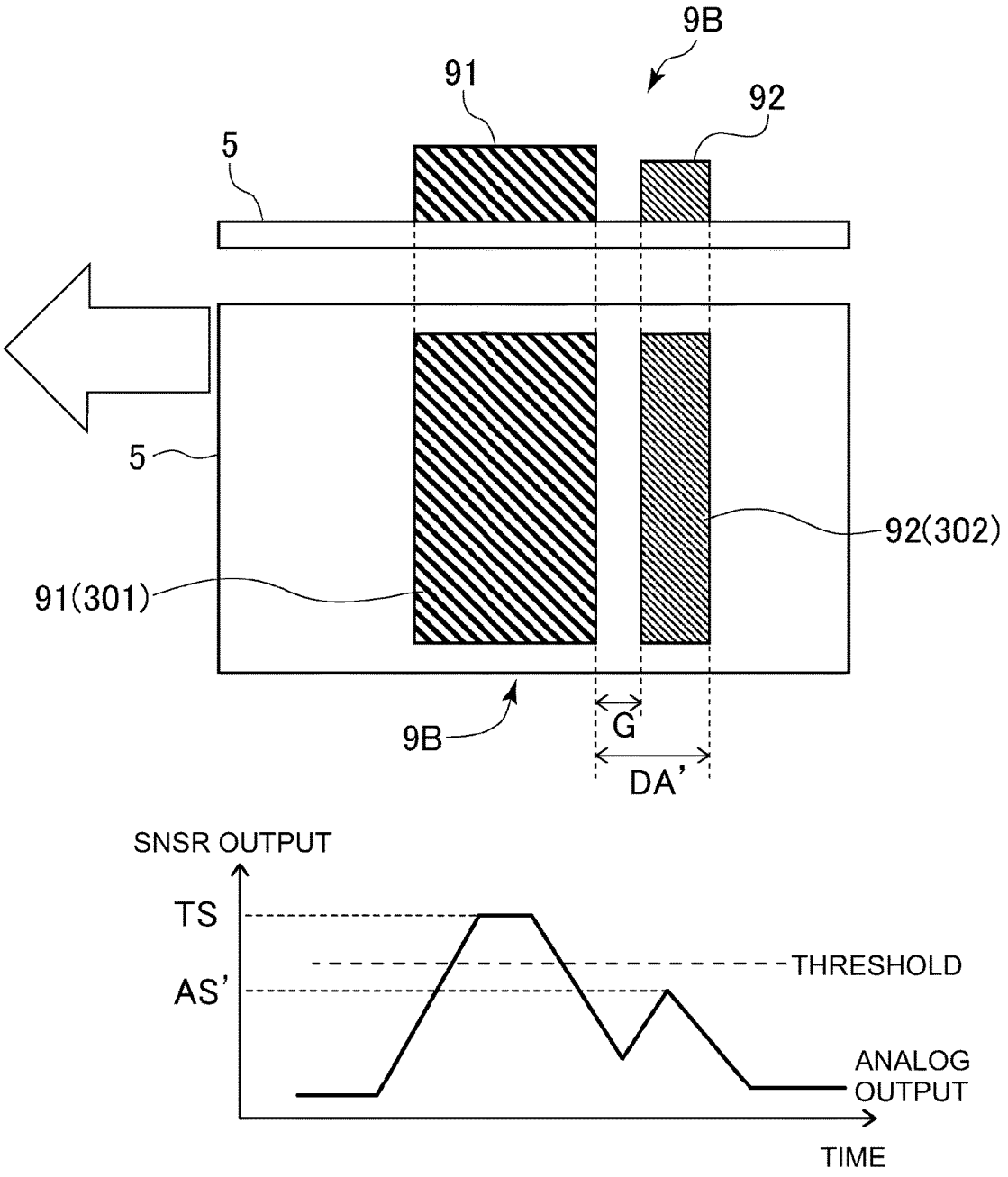

FIG. 13 is a sectional view and a top plan view schematically showing the color misregistration correction pattern of each color formed on the intermediary transfer belt in a second embodiment of the present invention, and a sensor output signal when each pattern is detected.

DESCRIPTION OF THE EMBODIMENTS

First Embodiment

Figure 1:
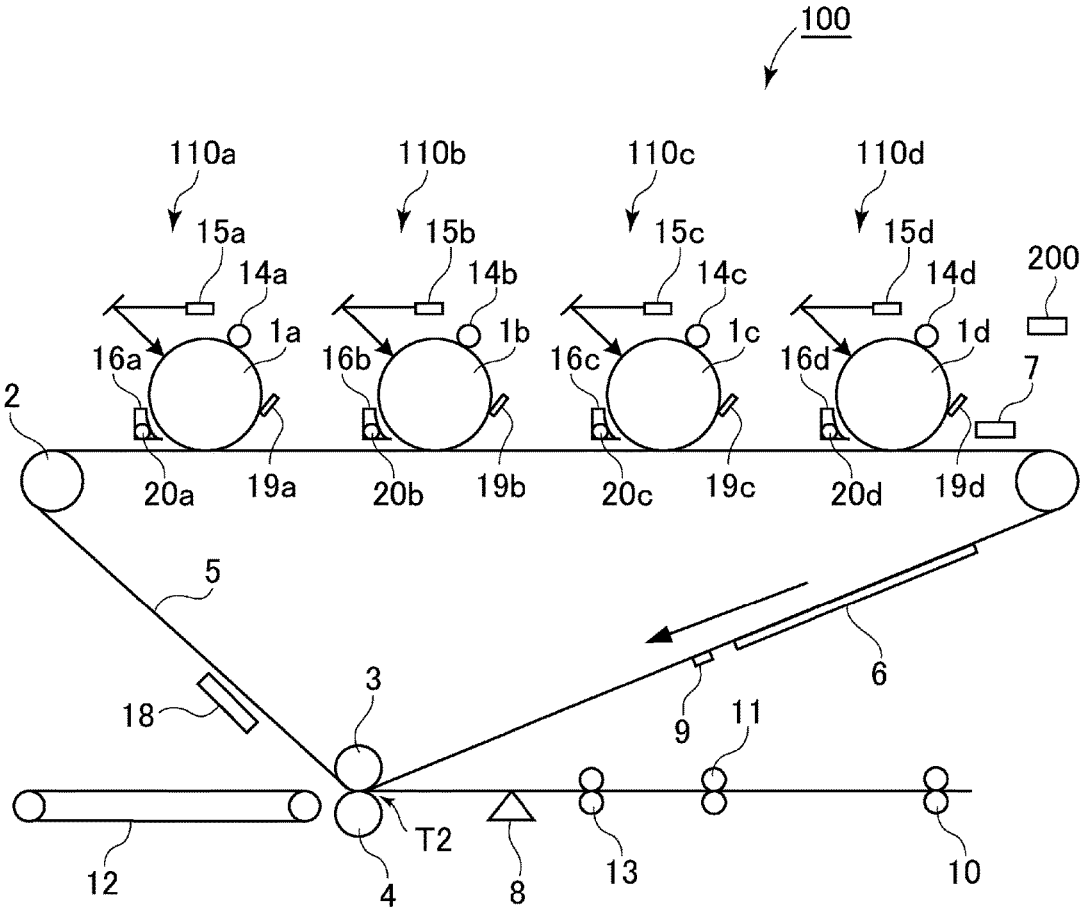
FIG. 1 is a schematic view of an image forming apparatus according to a first embodiment of the present invention.

Referring to FIG. 1 to FIG. 11, a first embodiment of the present invention will be described. Referring first to FIG. 1, the general arrangement of an image forming apparatus according to this embodiment will be described.

[Image Forming Apparatus]

An image forming apparatus 100 comprises a plurality of image forming stations 110*a*, 110*b*, 110*c*, 110*d* for forming toner images. The image forming stations 110*a*, 110*b*, 110*c*, 110*d* form a yellow (Y) toner image, a magenta (M) toner image, a cyan (C) toner image and a black (K) toner image, respectively. They are arranged in the order named along a travelling direction (moving direction) of an intermediary transfer belt (intermediary transfer member) 5 as a transfer member.

The image forming stations 110*a*, 110*b*, 110*c*, 110*d* include photosensitive drums 1*a*, 1*b*, 1*c*, 1*d*, exposure devices 15*a*, 15*b*, 15*c*, 15*d*, developing devices 16*a*, 16*b*, 16*c*, 16*d* and so on, respectively. In addition, the image forming stations 110*a*, 110*b*, 110*c*, 110*d* include charging devices 14*a*, 14*b*, 14*c*, 14*d* as charging means, and cleaners 19*a*, 19*b*, 19*c*, 19*d* as cleaning means, respectively.

The photosensitive drums 1*a*, 1*b*, 1*c*, 1*d* as image bearing members rotate along the travelling direction of the intermediary transfer belt 5, while carrying the toner images. The charging devices 14*a*, 14*b*, 14*c*, 14*d* electrically charge the surfaces of the photosensitive drums 1*a*, 1*b*, 1*c*, 1*d* to the predetermined potential. The exposure devices 15*a*, 15*b*, 15*s*, 15*d* as electrostatic latent image forming means form electrostatic latent images of respective colors on the charged surfaces of the photosensitive drums 1*a*, 1*b*, 1*c*, 1*d*, respectively. More particularly, the laser beams scan the surfaces in accordance with image signals for the respective colors to form electrostatic latent images on the photosensitive drums.

The developing devices 16*a*, 16*b*, 16*c*, 16*d* accommodate respective color toner particles and develop the electrostatic latent image formed on the surfaces of the photosensitive drums 1*a*, 1*b*, 1*c*, 1*d* with the respective color toner particles. More particularly, the developing devices 16*a*, 16*b*, 16*c*, 16*d* accommodate two-component developers each comprising non-magnetic toner and magnetic carrier, respectively. In addition, they include developing sleeves 20*a*, 20*b*, 20*c*, 20*d* as the developer carrying members, respectively, and stationary magnet rollers are provided inside the respective developing sleeves 20*a*, 20*b*, 20*c*, 20*d*. The toner and carrier in the developing device are stirred and fed therein, by which the toner is electrically charged to the negative polarity, and the carrier is electrically charged to the positive polarity. The toner and carrier charged to the polarities opposed to each other in this manner is carried on the developing sleeve 20*a*, 20*b*, 20*c*, 20*d* along the magnetic flux lines provided by the magnet roller, so that magnetic chains are formed. The developing sleeves 20*a*, 20*b*, 20*c*, 20*d* are rotated along the movement of the surfaces of the respective photosensitive drums 1*a*, 1*b*, 1*c*, 1*d*, that is, in the opposite directions. In this embodiment, peripheral movement speeds of the developing sleeves 20*a*, 20*b*, 20*c*, 20*d* are higher than those of the photosensitive drums 1*a*, 1*b*, 1*c*, 1*d*. The peripheral movement speed is the speed of the movement of the surface.

The magnetic chains with the respective color toner carried on the developing sleeves 20*a*, 20*b*, 20*c*, 20*d* are regulated to the predetermined heights by regulating blades (unshown), and are further charged and then fed to the developing positions where they are opposed to the photosensitive drums 1*a*, 1*b*, 1*c*, 1*d*, respectively. The magnetic chains with the respective toner rotate in contact with the photosensitive drums, and the toner articles jump toward the photosensitive drums by the application of the predetermined developing bias voltages between the developing sleeves and the photosensitive drums, so that the electrostatic latent image are developed by the respective toner particles. As a result, toner images are formed on the respective surfaces of the photosensitive drums 1*a*, 1*b*, 1*c*, 1*d*.

The toner image formed on the photosensitive drums 1*a*, 1*b*, 1*c*, 1*d* are transferred onto the intermediary transfer belt 5 superimposedlly, so that a full-color toner image 6 is formed. The intermediary transfer belt 5 is extended around a driving roller 2 and stretching rollers 3, and rotates (travels) in the direction indicated by an arrow in FIG. 1 by rotation of the driving roller 2. At the position opposing the stretching roller 3 across the intermediary transfer belt 5, there is provided a transfer roller 4 to establish a secondary transfer portion T2. The toner image 6 formed on the intermediary transfer belt 5 is fed to the secondary transfer portion T2, where it is transferred onto a recording material such as a sheet of paper, OHP sheet or the like. The recording material is fed out of a cassette (unshown) by feeding rollers 10 and 11 and is corrected in the oblique feeding by registration rollers 13, and thereafter, a leading end thereof is detected by a leading end sensor 8. The recording material is fed into the secondary transfer portion T2 in synchronism with the toner image 6 said by the intermediary transfer belt 5, by the registration rollers 13.

The recording material carrying the transferred toner image is fed into a fixing device (unshown) by the feeding belt 12, where it is pressed and heated, so that the image is fixed on the recording material, and then the recording material covering the fixed image is discharged to an outside of the apparatus. The toner remaining on the photosensitive drum after the transfer of the toner image from the photosensitive drum onto the intermediary transfer belt 5 is removed by the cleaner 19*a*, 19*b*, 19*c*, 19*d*. Similarly, the toner remaining on the intermediary transfer belt 5 after the transfer of the toner image 6 from the intermediary transfer belt 5 onto the recording material is removed by a cleaning device 18.

Such operations of each part are controlled by a controller 200 as correcting means which is also controlling means. The controller 200 causes the image forming stations 110*a*, 110*b*, 110*c*, 110*d* to form a color misregistration correction pattern 9 as a toner image for correction. The controller 200 corrects the position of the toner image formed by the image forming stations, that is, carries out the color misregistration correction, on the basis of the result of detection, by a pattern sensor 7 as a toner detecting means, of the color misregistration correction patterns 9 of the respective colors transferred onto the intermediary transfer belt 5 For example, the color misregistration correction is carried out by shifting the writing timing of the exposure devices 15*a*, 15*b*, 15*c*, 15*d*.

The color misregistration correction pattern 9 transferred onto the intermediary transfer belt 5 is passed through the secondary transfer portion T2 while applying a bias voltage of the polarity opposite to that applied during the image transfer operation in the secondary transfer portion T2, or while spacing the transfer roller 4 from the intermediary transfer belt 5. The color misregistration correction pattern 9 is removed from the intermediary transfer belt 5 by the cleaning device 18 provided downstream of the secondary transfer portion T2 with respect to the travelling direction of the intermediary transfer belt 5.

[Pattern Sensor]

Referring to FIG. 1 in 2, the description will be made as to a pattern sensor 7 for detecting a color misregistration correction pattern 9. The pattern sensor 7 is disposed opposed to the surface of the intermediary transfer belt 5 at a position downstream of the downstreammost image forming station 110*d* with respect to the travelling direction of the intermediary transfer belt 5. The pattern sensor 7 reads the color misregistration correction pattern 9 of the colors formed on the intermediary transfer belt 5 of the predetermined timing in the above-described the manner, and the controlling operations which will be described hereinafter are carried out to effect the color misregistration correction.

Figure 2:
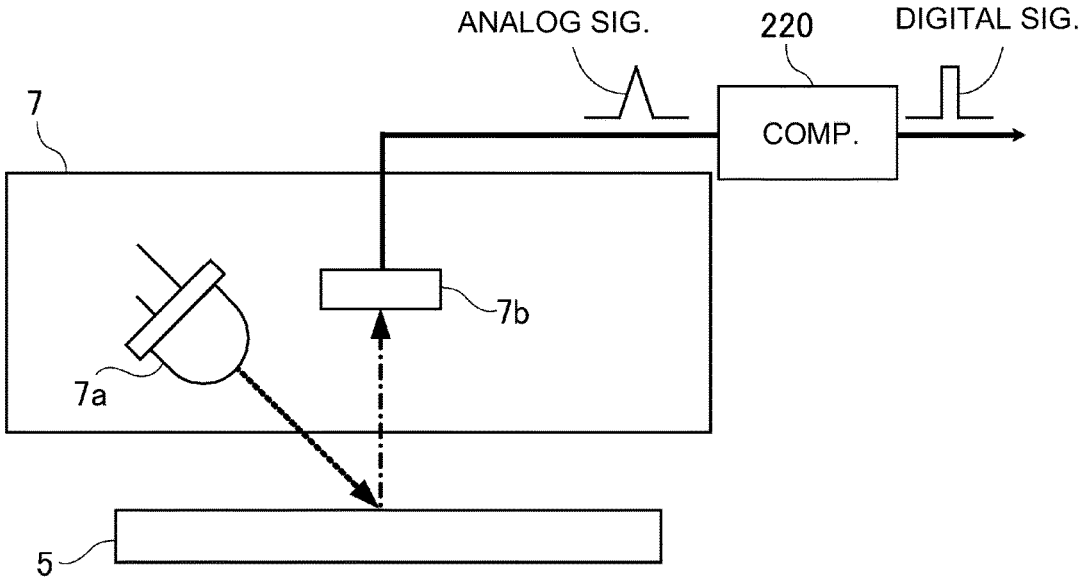
FIG. 2 is a schematic view illustrating a detecting structure of a pattern sensor.

The pattern sensor 7 is a reflection type optical sensor for detecting the color misregistration correction pattern 9 formed on the intermediary transfer belt 5 in the above-described manner. As shown in FIG. 2, the pattern sensor 7 comprises a light emission element 7*a* such as LED as light emitting means, and a light receiving element 7*b* as photoreceptor means. The light receiving element 7*b* are disposed such that the incident angle and the reflection angle are not equal to each other so that the light receiving element 7*b* can receive diffused light of the light from the light emission element 7*a* reflected by the intermediary transfer belt 5. During the assembly of the sensor, optical axes of the elements are adjusted such that the position of the pattern can be precisely detected. In the pattern sensor 7, the reflected light from the surface of the intermediary transfer belt 5 or the toner pattern formed on the surface of the intermediary transfer belt 5 is detected by the light receiving element 7*b*, and the detection result is voltage-converted and is outputted. The output voltage signal from the light receiving element 7*b* is inputted to a signal generation comparator 220.

[Color Misregistration Correction]

Figure 3:
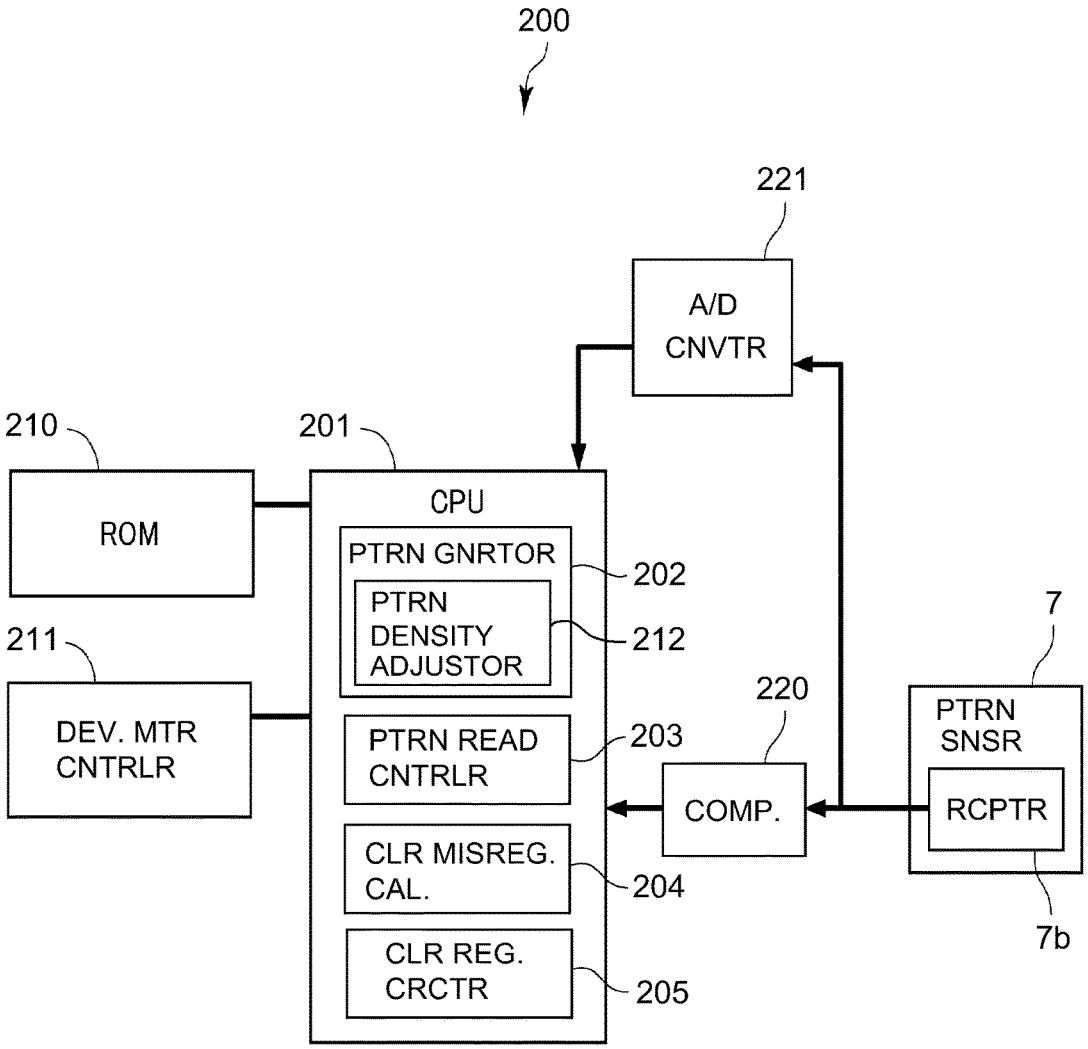
FIG. 3 is a control block diagram relating to a color misregistration correction in this embodiment.

Referring to FIG. 3 to FIG. 6, the description will be made as to the control for reading the color misregistration correction pattern 9 by the pattern sensor 7 to effect the color misregistration correction. As shown in FIG. 3, the controller 200 comprises a CPU 201, a ROM 210, a development motor controller 211, a signal generation comparator 220 and an A/D converter 221. The output voltage signal from the light receiving element 7*b* of the pattern sensor 7 is inputted to the signal generation comparator 220 and to the A/D converter 221. The A/D converter 221 converts the analog output voltage signal from the pattern sensor 7 to a digital signal so as to be recognized by the CPU 201. More particularly, a toner image (pattern) exclusively for the correction is formed in each of the colors, and the pattern sensor 7 detects the toner image to produce a signal, which is in then converted to the digital signal by the A/D converter 221. On the basis of the digital signal converted from the read signal of the pattern sensor 7, the CPU 201 can carry out various control operations.

Figure 4:
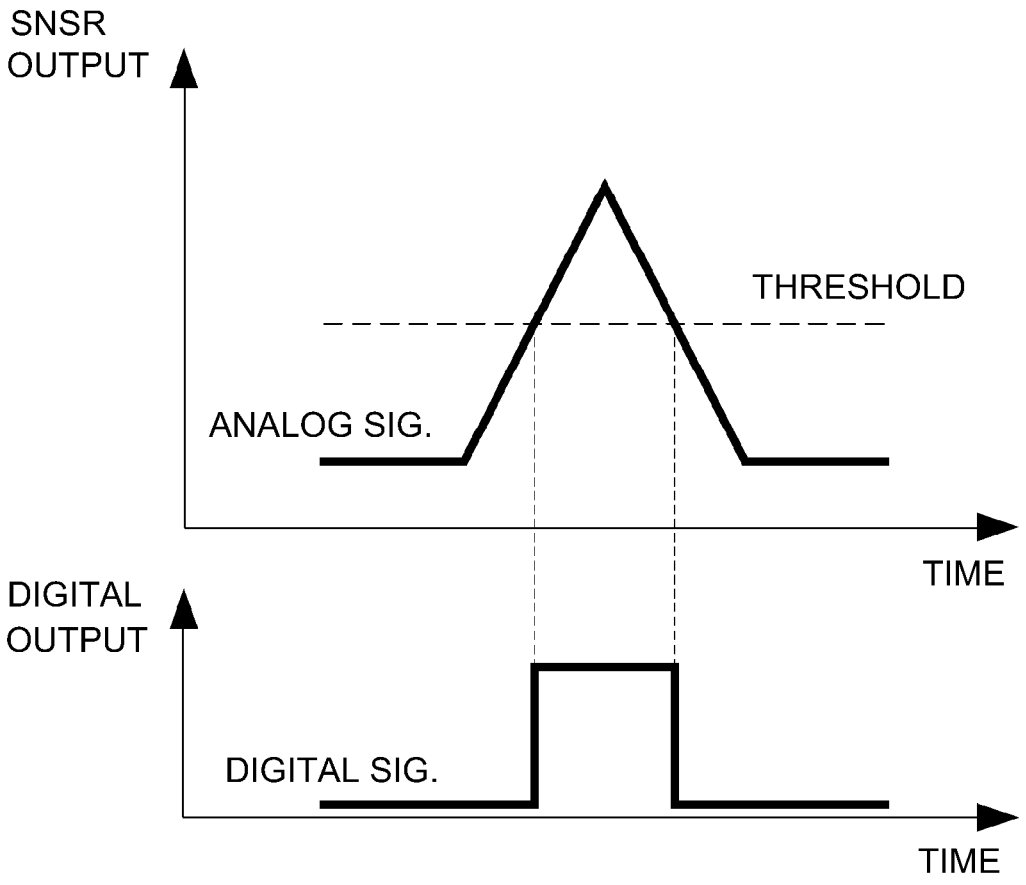
FIG. 4 illustrates a binarized signal of a signal detected by the pattern sensor.

As shown schematically in FIGS. 2 and 4, the signal generation comparator 220 binarizes the analog output voltage signal of the color misregistration correction pattern 9 read by the pattern sensor 7 on the basis of a predetermined threshold, and outputs the binary digital signal. That is, it is discriminated as to whether or not the analog output signal from the sensor exceeds the predetermined threshold indicated by a broken line in FIG. 4, and a binary digital signal depending on the result of discrimination is outputted. The digital signals outputted from the A/D converter 221 and the signal generation comparator 220 are inputted to the CPU 201.

The CPU 201 comprises a pattern generation portion 202 for generating image data of the toner pattern to be generated by the color misregistration correction control, a pattern read controller 203, a color misregistration calculating portion 204 and a color misregistration correction portion 205. The pattern generation portion 202 comprises a pattern density adjustment portion 212 for controlling laser power or a writing pulse width per one pixel outputted by the exposure device 15*a*, 15*b*, 15*c*, 15*d* to adjust the density of the pattern.

The pattern read controller 203 reads and temporarily stores the output signal of the pattern sensor 7 binarized by the signal generation comparator 220. The color misregistration calculating portion 204 calculates a deviation for each color on the basis of the read pattern data. The color misregistration correction portion 205 corrects the writing timing of the exposure device 15*a*, 15*b*, 15*c*, 15*d* on the basis of the color misregistration thus calculated. The control operations of the CPU 201 are carried out on the basis of program data stored in the ROM 210. The development motor controller 211 controls a rotational speed of the development motor.

Figure 5:
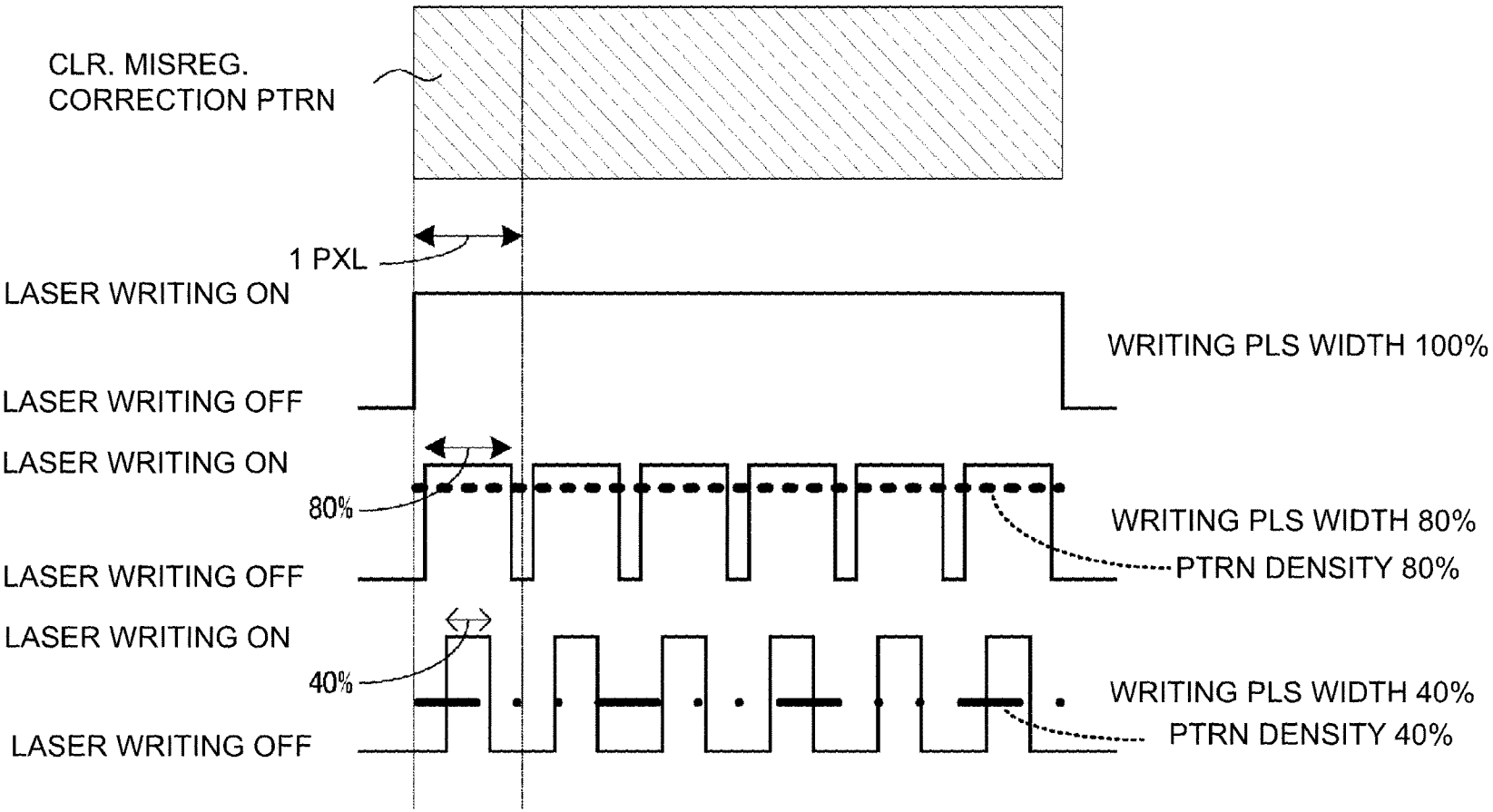
FIG. 5 illustrates a change of the density of the toner image by changing a width of a writing pulse.

FIG. 5 shows the change of the density of the color misregistration correction pattern 9 by changing the writing pulse width per one pixel by the exposure device 15*a*, 15*b*, 15*c*, 15*d*. In the ON laser writing range of the exposure device 15*a*, 15*b*, 15*c*, 15*d*, the latent image is formed on the photosensitive drum, and in the OFF laser writing range, no latent image is formed on the photosensitive drum, and the smoothing is carried out by the developing and transferring operations. Therefore, when, for example, the writing pulse width per one pixel is set at 80%, the whole pattern is formed uniformly at the density of 80%. When the writing pulse width per one pixel is set at 40%, the whole pattern is formed uniformly at the density of 40%.

Figure 6:
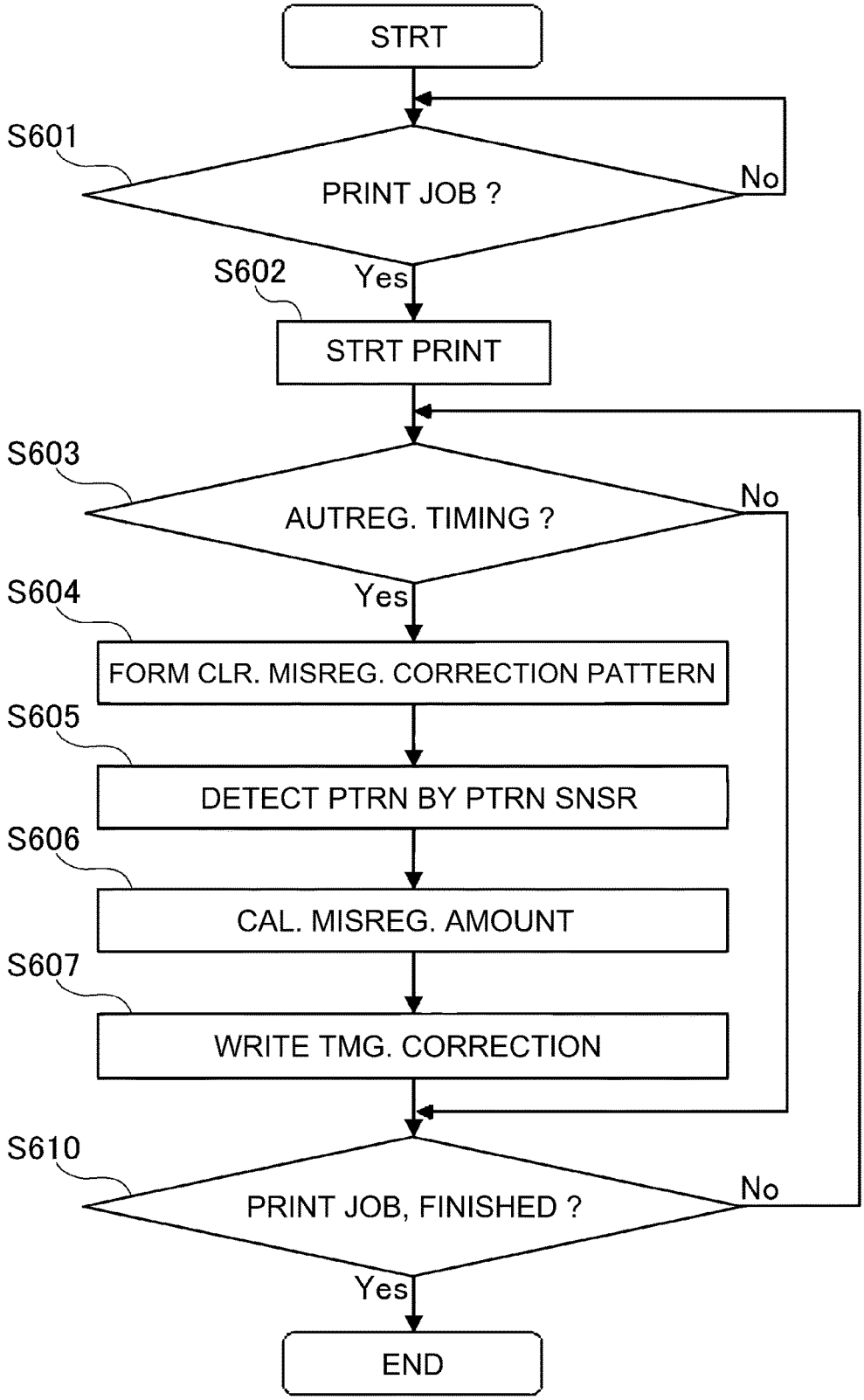
FIG. 6 is a flow chart showing a printing operation of the image forming apparatus.

FIG. 6 shows a printing operation by the image forming apparatus 100 according to this embodiment. The voltage source of the image forming apparatus 100 is actuated, and when the start of the print job is detected (S601), the controller 200 starts the printing operation (S602). At the start of the printing operation, if the print number is not less than a predetermined value, the color misregistration correcting operation (automatic registration) is carried out (S604-S607). And, it is discriminated as to whether or not the print job is finished (S610), and the printing operation is repeated or stopped.

The automatically registering operation will be described in detail. The image forming stations 110*a*, 110*b*, 110*c*, 110*d* of the image forming apparatus 100 have the same structures, and therefore, the structures of the image forming stations will be described without the suffixes a, b, c and d. When the developing device 16 is referred to, for example, the description applies to all of the developing devices 16*a*, 16*b*, 16*c*, 16*d*.

When the command of the start of the automatically registering operation is produced, a sheet interval or down time is provided, and the color misregistration correction pattern 9 is formed by the pattern generation portion 202 using the exposure device 15, so that the pattern does not appear on the output print (S604). More particularly, the color misregistration correction patterns 9 are formed by the respective color image forming stations and are transferred onto the intermediary transfer belt 5. Subsequently, the color misregistration correction patterns 9 formed on the intermediary transfer belt 5 are detected by the pattern sensor 7 (S605). Then, the output signal of the output signal is binarized by the signal generation comparator 220, and the binarized signal is temporarily stored in the pattern reading controller 203 Furthermore, the color misregistration amount is calculated on the basis of the pattern data read by the color misregistration calculating portion 204 (S606). The writing timing is corrected on the basis of the color misregistration amount calculated by the color misregistration correction portion 205, thus effecting the color misregistration correction.

[Phenomenon-of the Decrease of the Toner Amount at the Trailing Edge of the Color Misregistration Correction Pattern]

Figure 7:
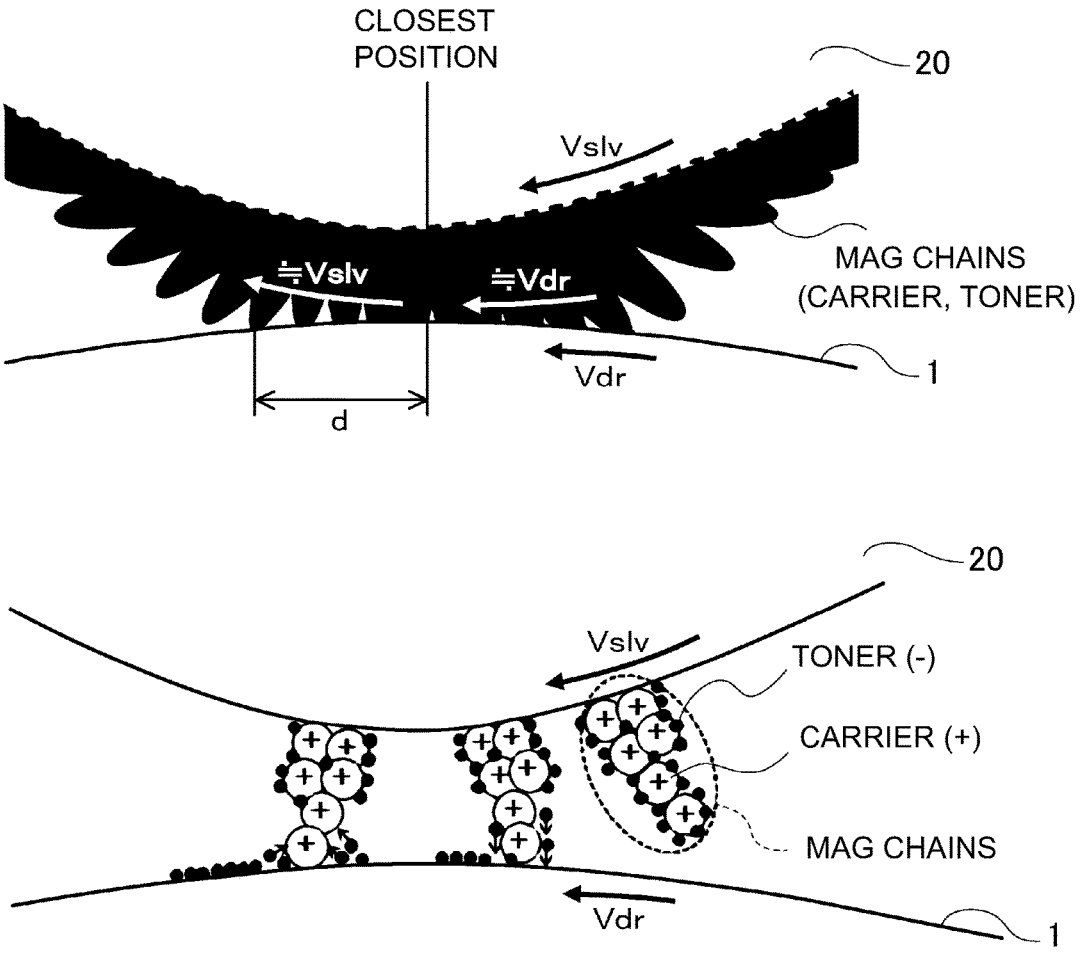
FIG. 7 is a schematic view illustrating the relationship between a developing sleeve, a photosensitive drum and toner.

Referring to FIG. 7, the phenomenon-of the decrease of the toner amount at the trailing edge (rear end) of the color misregistration correction pattern with respect to the moving direction of the intermediary transfer belt 5 (sub-scan direction), the phenomenon occurring in the case that there is a difference in the rotational speed between the photosensitive drum 1 and the developing sleeve 20. FIG. 7 is an enlarged view in the developing zone where the photosensitive drum 1 and the developing sleeve 20 are closest to each other. The upper part of FIG. 7 shows the behavior of the contact of the magnetic chain including the toner and carrier to the photosensitive drum 1, and the lower part of FIG. 7 is a schematic overview for better illustrations of the relationship between the toner and carrier of the magnetic chain.

The photosensitive drum 1 and the developing sleeve 20 rotate in the direction indicated by the respective arrows (so-called with-development). With the with-developing system, the rubbing force between the magnetic chain and the photosensitive drum 1 is smaller than with a counter developing system, and therefore, a high image quality image can be provided. When the photosensitive drum 1 is developed with the toner by the developing device 16, the magnetic chain is formed on the developing sleeve 20 along the magnetic flux line provided by the magnet roller disposed in the developing sleeve 20 which is the developer carrying member. The magnetic chain includes the toner and carrier, and the toner is deposited onto the positions of the electrostatic latent image on the photosensitive drum 1. In order to enhance the development property, a peripheral speed Vslv of the developing sleeve 20 is made higher than the peripheral speed Vdr of the photosensitive drum 1. This is because then a larger amount of the toner is given the chance of development for the electrostatic latent image (latent image pattern) on the photosensitive drum 1.

The magnetic chain formed on the developing sleeve 20 as a length of approx. 1 mm, for example, and a gap between the photosensitive drum 1 and the developing sleeve 20 is ordinarily several hundred μm in the closest portion. Therefore, in the area upstream of the closest portion, the magnetic chain is folded by the collision with the photosensitive drum 1. Therefore, the moving speed of the magnetic chain in the neighborhood 42 of the photosensitive drum 1 in the upstream area of the closest portion is lower than the peripheral speed Vslv of the developing sleeve 20, and moves toward the closest portion at the speed closer to the peripheral speed Vdr of the photosensitive drum 1.

The magnetic chain collides with the closest portion and is regulated in the length by the closest portion, and in the area downstream of the closest portion it moves substantially at the same speed as the peripheral speed Vslv of the developing sleeve 20. At this time, at the trailing edge of the latent image pattern to be developed with the toner with respect to the sub-scan direction, the magnetic chain passes by an area of the photosensitive drum 1 where the toner is not to be deposited and then passes by in the area where the toner is to be deposited. For example, the magnetic chain carried on the developing sleeve 20 passes by the area of the dark portion potential of the photosensitive drum 1 not exposed to the image light and then passes by the trailing edge of the latent image pattern with respect to the sub-scan direction.

In the area to which the toner is not to deposit, there is a force applied in the direction of moving the toner toward the developing sleeve 20, and therefore, the free end portion of the magnetic chain has only the carrier charged to the positive polarity. The positive polarity may remove the toner once deposited on the photosensitive drum off the photosensitive drum. As a result, the amount of the toner is relatively small in the trailing edge of the developed toner image (color misregistration correction pattern) of the latent image pattern with respect to the sub-scan direction, with the result that the density in the trailing edge is low, or no toner exists in the trailing edge.

The amount of the toner removed from the photosensitive drum 1 by the magnetic chain is determined by the distance through which the magnetic chain overtakes the toner deposited on the photosensitive drum 1, within the range of distance d from the closest portion between the photosensitive drum 1 and the developing sleeve 20 in which the magnetic chain contacts the photosensitive drum 1. The distance range in which the toner is removed off the photosensitive drum 1 is short when the toner density on the photosensitive drum 1 is high, and the distance range is long when the toner density is low. Particularly, when the humidity around the image forming station is high, the charge amount of the deposited toner is small, and therefore, the depositing force thereof to the photosensitive drum 1 is small, and the toner is relatively easily returned to the magnetic chain, and for this reason, the decrease of the toner mounting the trailing end is remarkable.

Figure 8:
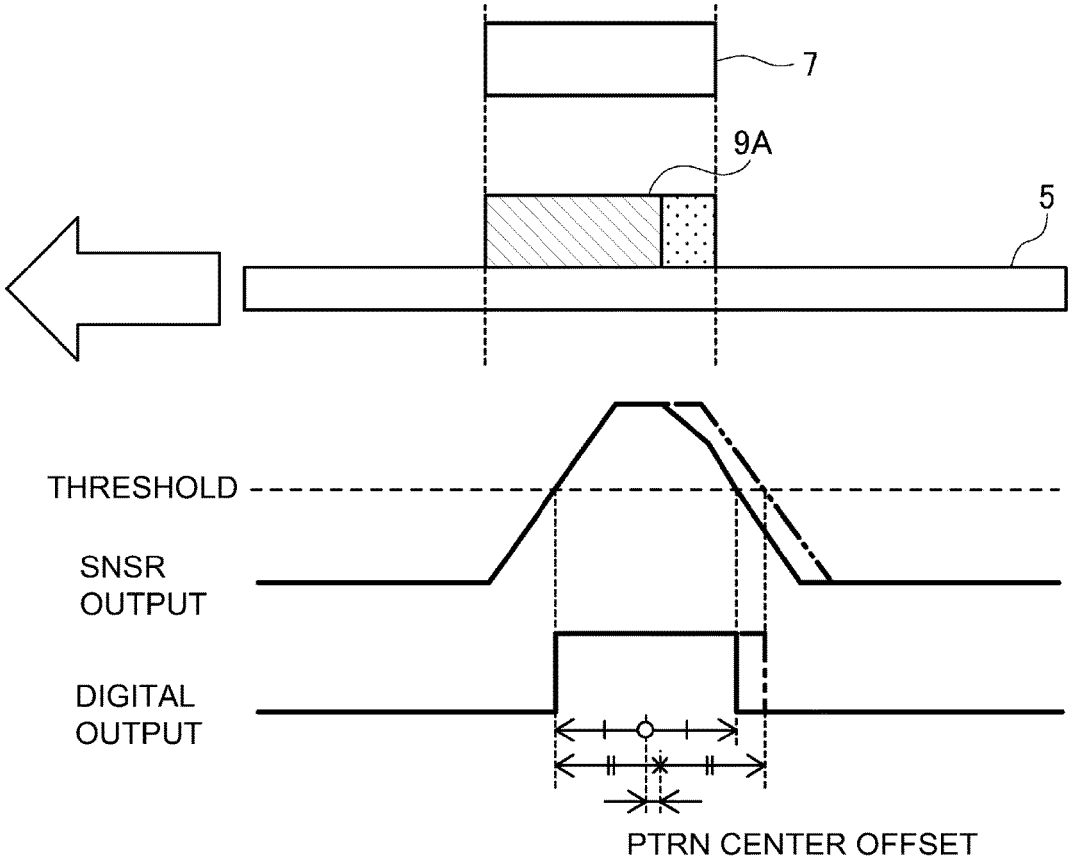
FIG. 8 shows a sensor output signal when the color misregistration correction pattern having a decreased density at the trailing end is read.

FIG. 8 shows the sensor output signal and the binarized signal thereof when the density of the color misregistration correction pattern 9A on the intermediary transfer belt 5 is low at the trailing edge. The hatched portion color misregistration correction pattern 9A depicts the area where the density is not low, and the stippled portion depicts the area where the density is low. The solid lines of the sensor output and the binarized digital output depict the outputs influenced by the decrease of the density, and the chain lines depict the outputs when it is assumed that they are not influenced by the decrease of the density.

When the position of the color misregistration correction pattern 9A is detected by the pattern sensor 7, a middle point between the rising signal and the falling of the binarized digital output of the output of the pattern sensor 7 are calculated, and the calculated middle point is deemed as the central position of the pattern. As indicated by the chain lines in the Figure, when the density is constant to the trailing edge of the color misregistration correction pattern 9A, the center position of the pattern is that indicated by "X" in FIG. 8. On the other hand, in the case of the decrease of the density at the trailing edge of the color misregistration correction pattern 9A as indicated by the solid lines, the center position of the pattern acquired from the binarized signal is indicated by "○" in FIG. 8. Thus, when the decrease of the trailing edge density of the color misregistration correction pattern 9A occurs, the center position of the pattern is deviated from the center position in the case without the trailing edge density decrease, and therefore, the position detection for the color misregistration correction pattern 9A is not correct. As a result, the correctly color misregistration correction is difficult.

[Color Misregistration Correction Pattern in this Embodiment]

In this embodiment, the color misregistration correction pattern 9 is formed in the manner described in the following to suppress the phenomenon-of the decrease or void of the toner amount of the developed color misregistration correction pattern at the trailing edge with respect to the sub-scan direction. As shown in part (a) of FIG. 9, the color misregistration correction pattern 9 comprises a main pattern 91 as a first toner image and a sub-pattern 92 as a second toner image. The main pattern 91 is formed to detect the center position of the pattern for each color, in order to effect the color misregistration correction. The sub-pattern 92 is formed continuing from the downstream side of the main pattern 91 with respect to the travelling direction of the intermediary transfer belt 5 in order to suppress the decrease of the toner amount at the trailing edge of the pattern 91 with respect to the sub-scan direction.

Therefore, the controller 200 is capable of executing the operation in a mode in which the electrostatic latent image for the color misregistration correction pattern 9 is formed by the exposure device 15. As shown in part (b) of FIG. 9, the electrostatic latent image comprises a first latent image pattern 301 and a second latent image pattern 302. The second latent image pattern 302 is formed in the downstream side of the first latent image pattern 301 with respect to the moving direction of the electrostatic latent image (the travelling direction of the intermediary transfer belt 5, the sub-scan direction).

The second latent image pattern 302 is formed such that the relationship between the developed toner image A at the time when the first latent image pattern 301 is formed by the operation of the mode and the developed toner image B at the time when a latent image pattern which is the same as the first latent image pattern is formed alone is as follows. That is, the area in which the toner is deposited is larger or the image density of the downstream end portion of the toner image with respect to the moving direction is higher in the toner image A than in the toner image B.

In this embodiment, the second latent image pattern 302 is continuous with the first latent image pattern 301, and the toner image density after the development thereof is lower than the toner image density of the first latent image pattern 302 after the development thereof. More particularly, the writing pulse width per one pixel by the exposure device 15 is changed such that an average latent image potential Av of the second latent image pattern 302 is lower than the average latent image potential Tv of the first latent image pattern 301, as shown in part (b) of FIG. 9. The latent image potentials Tv, Av are based on a potential Vd in the non-latent image forming region (dark portion potential) on the photosensitive drum 1. Part (b) of FIG. 9 is a schematic view of the time when the potentials of the first latent image pattern 301 and the second latent image pattern 302 on the photosensitive drum 1 are measured, respectively, independently from each other.

By forming the first latent image pattern 301 and the second latent image pattern 302, the color misregistration correction pattern 9 shown in part (a) of FIG. 9 is formed when the latent image pattern is developed by the developing device 16. The toner amount of the sub-pattern 92 is smaller than the toner amount of the main pattern 91, as is schematically shown in part (a) of FIG. 9. By providing the toner density difference between the pattern 91 and the sub-pattern 92 in this manner, the center position of the main pattern 91 alone can be detected from the sensor output as will be described hereinafter.

The distance range in which the toner is removed from the trailing edge of the sub-pattern 92 of the color misregistration correction pattern 9 is $$D=d\times\{(Vslv-Vdr)/Vslv\}\times\{(Tv-Av)/Tv\},$$

where d is a length (distance), measured in the peripheral moving direction, in which the developer (magnetic chain) carried on developing sleeve 20 is in contact with the photosensitive drum 1 in the downstream side of the closest portion between the photosensitive drum 1 and the photosensitive drum 1 with respect to the peripheral moving direction of the photosensitive drum 1, Vslv is a peripheral speed of the developing sleeve 20, Vdr is a peripheral speed of the photosensitive drum 1, Tv is a latent image potential of the first latent image pattern 301, and Av is a latent image potential of the second latent image pattern 302.

As described hereinbefore, the toner density of the main pattern 91 is higher than the toner density of the sub-pattern 92, and therefore, Tv>Av>0.

In the above equation, {(Vslv−Vdr)/Vslv} is a relative speed ratio at which the developing sleeve 20 overtakes the photosensitive drum 1. Therefore, d×{(Vslv−Vdr)/Vslv} expresses a distance by which the magnetic chain on the developing sleeve 20 overtakes the photosensitive drum 1 within the range of the distance d. For example, when d=1 mm, Vslv=400 mm/s, Vdr=300 mm/s, the magnetic chain overtakes the photosensitive drum by 0.25 mm. Therefore, the toner is gradually removed off from the trailing edge of the sub-pattern 92 upon passing the sub-pattern 92 by 0.25 mm after the magnetic chain on the developing sleeve 20 passes by the area of the photosensitive drum 1 where the toner is not to deposit.

However, when the toner density of the sub-pattern 92 is high, the toner supply amount from the trailing edge of the sub-pattern 92 to the passing magnetic chain is large, and therefore, the distance range D in which the toner is removed off from the trailing edge is short. On the other hand, when the toner density of the sub-pattern 92 is low, the toner supply amount from the trailing edge of the sub-pattern 92 is small, and the distance range D in which the toner is removed off from the trailing edge is long. Therefore, when the latent image potential Av of the second latent image pattern for forming the sub-pattern 92 is large, the toner density of the sub-pattern 92 is high, and therefore, {(Tv−Av)/Tv} is small, and the distance range D is short. On the other hand, when the latent image potential Av is small, the toner density of the sub-pattern 92 is low, and therefore, {(Tv−Av)/Tv} is large, and the distance range D is long.

In any case, the second latent image pattern 302 is formed such that the following is satisfied where DA is the length of the second latent image pattern 302 measured in the moving direction (sub-scan direction):

$$DA>d\times\{(Vslv-Vdr)/Vslv\}\times\{(Tv-Av)/Tv\}.$$

That is, DA is larger than D. By doing so, the range in which the toner is removed off by the magnetic chain is within the sub-pattern 92 formed by the second latent image pattern 302. As a result, the trailing edge density decrease is limited within the sub-pattern 92, so that the trailing edge density decrease of the main pattern 91 can be avoided.

Referring to FIGS. 10 and 11, the description will be made as to the detection of the color misregistration correction pattern 9 thus formed and then transferred onto the intermediary transfer belt 5 by the pattern sensor 7. The color misregistration correction patterns for the respective colors are indicated by 9*a*, for yellow, 9*b* for magenta, 9*c* for cyan and 9*d* for black. The main patterns for the respective colors are indicated by Yt for yellow, Mt for magenta, Ct for cyan and Kt for black, and the sub-patterns for the respective colors are indicated by Ya for yellow, Ma for magenta, Ca for cyan and Ka for black.

As shown in FIG. 10, the sensor output of the light receiving element 7*b* of the pattern sensor 7 is low because the diffused reflection component of the reflected light from the intermediary transfer belt 5 is low. On the other hand, when there is yellow, magenta or cyan toner image (color pattern) of the pattern image on the intermediary transfer belt 5, the diffused reflection component is large, and therefore, the sensor output is high. As shown in FIG. 10, for the detection of the black toner image (black pattern), the black toner image is formed on the color toner image (magenta toner image Mt, for example) already formed on the surface of the intermediary transfer belt 5. That is, the black color misregistration correction pattern 9*d* is formed on the magenta pattern Mt (undercoating). By doing so, the sensor output from the black pattern is low because the diffused reflection component from the black pattern is small, and the sensor output from the color pattern is high because the diffused reflection component there from is large, and therefore, the sensor output waveform shown in the Figure is provided, and the black pattern can be detected.

Part (b) of FIG. 10 shows the color misregistration correction pattern for the colors actually formed on the intermediary transfer belt 5. The color misregistration correction patterns are formed with inclination relative to the travelling direction of the intermediary transfer belt 5. By doing so, the color misregistrations in the main scan direction and in the sub-scan direction can be detected simultaneously.

FIG. 11 shows the sensor output signals and the binarized signals thereof when the pattern sensor 7 detects (a) the color patterns 9*a*, 9*b*, 9*c* and (b) the black pattern 9*d*. Part (a) of FIG. 11 shows only the yellow pattern 9*a* as the color pattern, but the same applies to the magenta pattern 9*b* and the cyan pattern 9*c*. The white void portion of the pattern trailing edge in the Figure depicts the portion (lowered density portion) where the toner image density is decreased.

As shown in FIG. 11, in this embodiment, the predetermined threshold is set at a level between an output (sensor output) when the main patterns Yt, Kt are detected by the pattern sensor 7 and an output when the sub-patterns Ya, Ka are detected by the pattern sensor 7. Therefore, the predetermined threshold is higher than the sensor output of the sub-pattern Ya of the yellow pattern 9*a* and is lower than the sensor output of the sub-pattern Ka of the black pattern 9*d*. Using the threshold thus set, the outputs of the patterns Yt, Kt are binarized (digital outputs). The center positions of the output side ranges of the binarized signals of the main patterns Yt, Kt at the threshold with respect to the moving direction of the color misregistration assistance pattern (travelling direction of the intermediary transfer belt 5) are determined, and on the basis of the determination, the positions of the toner images formed by the image forming stations are corrected.

That is, as to the yellow pattern 9*a*, the middle point between the rising signal and the falling signal of the binarized output (digital output) is calculated, and the middle point is deemed as the position of the center of the yellow pattern. As to the black pattern 9*d*, the middle point between the falling signal and the next rising signal of the magenta pattern Mt which is disposed in a leading side with respect to the travelling direction of the intermediary transfer belt 5, and the middle point is deemed as the position of the center of the black pattern 9*d*. The trailing edge densities of the sub-pattern are decreased in both of the color patterns 9*a*, 9*b*, 9*c* and the black pattern 9*d* due to the mechanism described in conjunction with the FIGS. 7, 8, but the center positions of the main patterns are not deviated because the trailing edge density decrease of the main patterns is suppressed. Therefore, the positions of the main patterns can be detected precisely, and therefore, the color misregistration correction can be effected with high precision.

In this embodiment, the settings are as follows, for example. The potential (dark portion potential) of the non-latent image forming region on the photosensitive drum 1 Vd=−600V; the center value of the potential applied to the developing sleeve 20 Vdc=−400V; the latent image potential of the main pattern 91 Tv=440V; the latent image potential of the sub-pattern 92 Av=260V. In this case, the sensor output of the pattern sensor 7 from the non-latent image region of the color pattern is 0.5V, and the sensor output from the main pattern is 4.0V. When the toner is not removed off the sub-pattern in the developing process, the sensor output signal of approx. 0.9V from the sub-pattern is expected. On the other hand, if all the toner is removed off the sub-pattern, the sensor output is 0.5V.

The sensor output of the main pattern for the black is 0.3V, and the sensor output between 3.6V and 4.0V from the sub-pattern is expected, when the possibility of the removing-off of the toner is taken into account. Therefore, the threshold for detecting the center position of the main pattern is 2.5V which is between the sensor output from the sub-pattern for the chromatic color and the sensor output from the sub-pattern for the black.

When the peripheral speed of the photosensitive drum 1 Vdr=300 mm/s, and the peripheral speed of the developing sleeve 20 Vslv=420 mm/s, the distance in which the magnetic chain is in contact with the photosensitive drum in the downstream area of the closest position between the photosensitive drum 1 and the developing sleeve 20 is d=1.5 mm. The distance range D in which the toner is removed off the trailing edge of the sub-patch with respect to the sub-scan direction is approx. 270 μm, using the set values and the equation. Therefore, the length DA of the sub-patch measured in the sub-scan direction is set at 500 μm which is larger than the distance D.

The preferable range of the formation position of the sub-pattern 92 in this embodiment will be described. If the color misregistration is not less than 100 μm, it is not visible microscopically, but it is visible macroscopically depending on the image forming condition. For example, when multicolor image formation is carried out, blurriness (haziness) is visible in a small point letter or image pattern, thus deteriorating the image quality. In this embodiment, it is preferable that the formation positions of the sub-patterns 92 are selected such that the color misregistration is less than 100 μm. In order to accomplish this, it is preferable that the formation position (density, width in the sub-scan direction, or the like) of the sub-pattern 92 is determined at the trailing edge of the main pattern 91, so that the main pattern 91 is not scraped off (or the density is decreased) in 200 μm or larger range from the trailing edge toward the leading end with respect to the sub-scan direction. In other words, it is preferable that the difference between the toner width provided by the actual development of the first latent image pattern which is the latent image of the main pattern 91 and the width of the first latent image pattern in the image moving direction is not more than 200 μm. That is, it is preferable that the formation position of the second latent image pattern which is the latent image of the sub-pattern 92 is selected so as to satisfy the above-described condition. In addition, the formation position of the sub-pattern 92 is selected such that the toner is substantially not scraped off by the magnetic chain when the main pattern 91 is developed, as, as a matter of course.

As described in the foregoing, in this embodiment, the electrostatic latent image for forming the color misregistration correction pattern 9 which is the toner image for correction comprises the first latent image pattern 301 and the second latent image pattern 302 which is in the downstream side of the first latent image pattern 301. The toner image at the time when the first latent image pattern 301 is developed is larger than the toner image at the time when the same latent image pattern is formed and developed alone, or the image density of the downstream end portion (trailing edge) with respect to the moving direction is relatively higher.

That is, even in the case that the toner of the toner image is evacuated at the trailing edge when the latent image pattern which is the same as the first latent image pattern 301 is formed and developed alone, the toner remains in the trailing edge of the main pattern 91 because of the formation of the second latent image pattern 302. In addition, even in the case that the density of the toner decreases at the trailing edge of the toner image at the time when the latent image pattern which is the same as the first latent image pattern 301 is formed and developed alone, the decrease of the toner density in the trailing edge of the main pattern 91 can be suppressed by the formation of the second latent image pattern 302. And, the toner density may be made higher as compared with the above-described case.

Furthermore, in this embodiment, the sub-pattern 92 provided by the development of the second latent image pattern 302 exists in the downstream of the main pattern 91 provided by the development of the first latent image pattern 301, so that the toner is not attracted back to the magnetic chain at the trailing edge of the main pattern 91. In other words, the toner is attracted back to the magnetic chain from the sub-pattern 92 not the trailing edge of the main pattern 91, so that the decrease of the toner density or evacuation of the toner in the trailing edge of the main pattern 91 can be suppressed.

Therefore, the main pattern 91 at the time when the first latent image pattern 301 is developed can be precisely detected by the pattern sensor 7. That is, the deviation of the center position of the main pattern 91 detected by the pattern sensor 7 can be suppressed. As a result, with the structure using the two-component developer, the correction of the toner image positions formed by the image forming stations 110 can be precisely carried out.

In this embodiment, as shown in FIG. 4, the light quantity signal waveform detected by the light receiving element 7*b* is compared on the basis of a predetermined threshold, on the basis of which a pulse signal is produced to determine the gravity center position (center position) of the pulse, and the automatic registration is carried out. However, the pulse signal may be produced corresponding to the center position of the peak of the signal waveform, and the automatic registration is carried out on the basis of the pulse signal. For example, by differentiating the signal waveform, the rising position of the signal and the falling position thereof can be detected, and the center position can be determined on the basis of them.

Second Embodiment

Referring to FIG. 12, a second embodiment of the present invention will be described. In this embodiment, a plurality of the thresholds for binarizing the signal detected by the pattern sensor 7 are used. The other structures and functions are the same as those of the above-described first embodiment, and therefore, in the description of this embodiment, the same reference numerals as in the first embodiment are assigned to the elements having the corresponding functions in this embodiment, and the detailed description thereof is omitted for simplicity.

In this embodiment, by the provision of the polarity of the thresholds for the sensor output of the color misregistration correction pattern 9, the formation of the black pattern 9*d* is easy. In this embodiment, an infrared radiation is emitted from the light emission element 7*a*, and the reflected radiation is detected by the light receiving element 7*b* of the pattern sensor 7. The black pattern 9*d* absorbs the infrared radiation, and therefore, the sensor output from the black pattern 9*d* is lower than the sensor output from the intermediary transfer belt 5, although the surface configuration of the intermediary transfer belt 5 is smoother than that of the black pattern 9*d*.

Under the circumstances, in this embodiment, the threshold is prepared for the black pattern 9*d*, in addition to the threshold for the color patterns 9*a*, 9*b*, 9*c*. That is, the threshold for the color pattern is made higher than the sensor output from the intermediary transfer belt 5, and the threshold for the black pattern 9*d* is made lower than the sensor output of the intermediary transfer belt 5. Both of the thresholds are selected so as to be between the sensor outputs from the main pattern and the sub-pattern, similarly to the first embodiment. By doing so, the black pattern 9*d* may be formed of the black toner alone without the color pattern therebelow as in the first embodiment, and the center position of the color misregistration correction pattern for the black can be detected.

In this embodiment, the sensor output from the diffused reflection light from the intermediary transfer belt 5 is 1.2V, and the sensor output from the main pattern for the chromatic color is 4V, the sensor output from the sub-pattern is 1.5V, and the threshold is 2.6V. The sensor output from the main pattern for the black is 0.5V, and the sensor output from the sub-pattern is 1.4V, and therefore, the threshold for the black pattern is 0.8V.

The peripheral speed of the photosensitive drum 1 is Vdr=250 mm/s, the peripheral speed of the developing sleeve 20 is Vslv=450 mm/s, and the distance range in which the magnetic chain is in contact with the photosensitive drum in the area downstream of the closest position between the photosensitive drum and the developing sleeve d=1.5 mm. The distance range from the trailing edge of the sub-pattern with respect to the sub-scan direction in which the toner is removed off is calculated as being approx. 1.1 mm from the set values and the equation. Therefore, the length DA of the sub-pattern in the sub-scan direction is set to be 1.5 mm which is larger than the distance D.

As described in the foregoing, by using a plurality of the thresholds for the sensor output from the color misregistration correction pattern 9, the density decrease at the trailing edge can be prevented to accomplish the precise pattern detection by a simple structure of the black pattern including the main pattern and the sub-pattern only.

Third Embodiment

Referring to FIG. 13, a third embodiment of the present invention will be described. In this embodiment, a second latent image pattern 302 for forming the color misregistration correction pattern 9B is spaced from a first latent image pattern 301. Therefore, the main pattern 91 and the sub-pattern 92 are spaced from each other. The other structures and functions are the same as those of the above-described first or second embodiment, and therefore, in the description of this embodiment, the same reference numerals as in the first and second embodiments are assigned to the elements having the corresponding functions in this embodiment, and the detailed description thereof is omitted for simplicity.

In this embodiment, the first latent image pattern 301 and the second latent image pattern 302 are spaced from each other, and the gap therebetween satisfies the following condition. The toner image at the time when the first latent image pattern 301 is developed is larger than the toner image at the time when the same latent image pattern is formed and developed alone, or the image density of the downstream end portion (trailing edge) with respect to the moving direction is relatively higher. If this condition is satisfied, it is not inevitable to form the first latent image pattern 301 and the second latent image pattern 302 continuously as in the first and second embodiments.

More detailed descriptions will be made. When the latent image potential of the color misregistration correction pattern (first latent image pattern) is provided by the main pattern 91 alone, the toner image it is smaller than the provided latent image potential region, due to the density decrease at the trailing edge. However, even if the sub-pattern 92 is disposed in the downstream side of the main pattern 91 with respect to the moving direction of the intermediary transfer belt 5, the toner image corresponding to the latent image potential range of the main pattern 91 is larger than that in the case of the main pattern alone, as the case may be. Thus, even when the sub-pattern 92 is formed by the latent image potential spaced from the main pattern 91 within the range in which the trailing edge density of the main pattern 91 does not decrease, the accuracy of the color misregistration correction can be improved.

In other to prevent the trailing edge density decrease of the main pattern 91, an area not forming that the toner image is provided in the range of distance G from the main pattern 91 toward the downstream with respect to the moving direction of the intermediary transfer belt 5, and after the area, the sub-pattern 92 is formed. The trailing edge of the sub-pattern 92 is at the distance DA' of the trailing edge of the main pattern 91. That is, the DA' is the sum of the length of the sub-pattern 92 and the distance G.

As described in conjunction with FIG. 7, in order to enhance the development property, the peripheral movement speed Vslv of the developing sleeve 20 is made higher than the peripheral movement speed Vdr of the photosensitive drum 1. The peripheral movement speed Vslv is selected within the range of 200% speed ratio relative to the peripheral movement speed Vdr. In such a case, the provision of the second latent image pattern 302 spaced from the first latent image pattern 301 by the distance G is effective to concentrate to the toner toward the free end of the magnetic chain in the second latent image pattern 302. By this, even when the magnetic chain passes through the distance G region (non-latent image region), the chance of the free end carrier of the magnetic chain having the positive charge colliding the first latent image pattern 301 decreases.

For example, when the speed ratio of the developing sleeve 20 relative to the photosensitive drum 1 is 180%, and the latent image potential of the second latent image pattern 302 is 450V which corresponds to the solid first latent image pattern 301, the density decrease of the trailing edge of the main pattern 91 can be prevented when the G is not more than 300 μm. However, the distance G is long, the time period in which the magnetic chain is in the non-latent image region increases with the result of increase of the chance of the magnetic chain having the positively charged free end portion colliding with the first latent image pattern 301. For this reason, the distance G is preferably short. When the latent image potential of the second latent image pattern 302 is small and therefore the toner density is low, the concentration of the toner to the free end of the magnetic chain is weakened, and therefore, the latent image potential of the second latent image pattern 302 is preferably high.

The length DA' which is in the sum of the length of the second latent image pattern 302 and the distance G is preferably longer than the distance D, because then the chance of the concentration of the toner toward the free end of the magnetic chain. In this embodiment, the distance G is 200 μm, and the length DA' is 500 μm. The sensor output TS from the main pattern 91 is 4V, and the sensor output AS' from the sub-pattern 92 is 3V. By this, the density decrease at the trailing edge of the main pattern 91 for the detection of the position of the color misregistration correction can be prevented to accomplish the precise color misregistration correction.

In this embodiment, because the first latent image pattern 301 and the second latent image pattern 302 are spaced from each other, the toner images of these latent image patterns can be identified even if the latent image potentials are the same. For example, even if the toner density decreases at the trailing edge of the sub-pattern 92 to such an extent that the toner density at the leading end is the same as that of the main pattern 91, the patterns can be discriminated from the output signals because they are spaced from each other.

Other Embodiments

In the foregoing description, the developing sleeve 20 is rotated at the peripheral speed which is higher than that of the photosensitive drum 1, but in the present invention is applicable to the case in which they are the same. Even if they are the same, the magnetic chain carried on the developing sleeve 20 repeatedly falls and erects by the magnetic flux line provided by the magnet roller. Therefore, when the magnetic chain erects, the moving speed of the magnetic chain exceeds the moving speed of the surface of the photosensitive drum 1 at a time. At this time, the toner may be removed by the magnetic chain due to the same mechanism as described in the foregoing. Therefore, with the case of the same speed structure, the present invention is applicable to improve the precision of the detection of the color misregistration correction pattern 9.

In the foregoing description, the magnetic chain (developer) carried on the developing sleeve 20 contacts and the photosensitive drum 1, but the present invention is applicable to the structure in which they are not contacted. Even if the magnetic chain does not contact to the photosensitive drum, the toner may be removed off the drum onto the magnetic chain, and therefore, the present invention is effective to improve the precision of the color misregistration correction pattern 9.

In the foregoing, the toner image formed on the photosensitive drum 1 is once transferred onto the intermediary transfer belt 5 and then transferred onto the recording material. However, the present invention is applicable to the structure in which the toner image is transferred from the photosensitive drum directly onto the recording material. For example, the color misregistration correction pattern is transferred onto a recording material feeding belt for feeding the recording material along the surface of the photosensitive drum, and the color misregistration correction pattern formed on the recording material feeding belt is detected by the pattern sensor. Or, the color misregistration correction pattern is transferred onto the recording material, and the formed pattern is detected by the pattern sensor. In the case of such a direct transfer system, the recording material feeding belt or the recording material corresponds to the transfer member.

In this embodiment, the electrostatic latent image for forming the toner image for correction comprises the first latent image pattern and the second latent image pattern which is downstream of the first latent image pattern with respect to the moving direction of the electrostatic latent image. The toner image at the time when the first latent image pattern 301 is developed is larger than the toner image at the time when the same latent image pattern is formed and developed alone, or the image density of the downstream end portion (trailing edge) with respect to the moving direction is relatively higher. Therefore, the toner image at the time when the first latent image pattern is developed can be precise on the detected by the toner detecting means, and therefore, the correction of the position of the toner image formed by the image forming station can be precisely carried out in the structure using two-component developer.

INDUSTRIAL APPLICABILITY

According to the present invention, there is provided an image forming apparatus in which the correction of the position of the toner image formed by the image forming station can be effected with high precision, in the device using the two-component developer.

The invention claimed is:

1. An image forming apparatus comprising:

a first image forming station configured to form a toner image and a second image forming station configured to form a toner image, each of the first image forming station and the second image forming station including a rotatable image bearing member, a latent image forming device configured to form an electrostatic latent image on the image bearing member, and a developing device configured to develop the electrostatic latent image formed on the image bearing member, the developing device including a developer carrying member configured to carry a developer comprising toner and a magnetic carrier and movable in the same direction at a position where the developer carrying member is opposed to the image bearing member;

a toner sensor configured to detect a toner image for registration correction of images formed by the first image forming station and the second image forming station; and a controller capable of executing an operation in a position correction mode for correcting a writing position of the images formed by the first image forming station and the second image forming station on the basis of a result of detection of the toner images for the registration correction by the toner sensor, wherein in the operation in the position correction mode, the controller controls each of the first image forming station and the second image forming station such that in each of the first image forming station and the second image forming station, a first latent image pattern which is a latent image for the toner image for the registration correction and a second latent image pattern are formed such that, in the first image forming station, the first latent image pattern and the second latent image pattern are formed on the same image bearing member of the first image forming station, in the second image forming station, the first latent image pattern and the second latent image pattern are formed on the same image bearing member of the second image forming station, in each of the first image forming station and the second image forming station, the second latent image pattern is formed at an upstream side of the first latent image pattern with respect to a moving direction of the image and is not formed at a downstream side of the first latent image pattern, and in each of the first image forming station and the second image forming station, the second latent image pattern is continuous with the first latent image pattern, and an image density of the toner image provided by developing the second latent image pattern is lower than an image density of the toner image provided by developing the first latent image pattern.

2. An apparatus according to claim 1, wherein the controller controls each of the first image forming station and the second image forming station such that a formation position of the second latent image pattern is such that a difference between the width, measured in the image moving direction, of the toner image resulting from the development of the first latent image pattern and a width of the first latent image pattern is not more than 200 μm.

3. An apparatus according to claim 1, wherein in each of the first image forming station and the second image forming station, the developer carrying member carries the developer so that the developer contacts the image bearing member, and wherein a length DA of the second latent image pattern measured in the moving direction, a length d, measured in a rotational moving direction of the image bearing member, of a range downstream of a closest portion between the image bearing member and the developer carrying member in which the developer carried on the developer carrying member is in contact with the image bearing member, a peripheral movement speed Vdr of the image bearing member, a peripheral movement speed Vslv of the developer carrying member, a latent image potential Av of the second latent image pattern, and a latent image potential Tv of the first latent image pattern satisfy:

$$DA > d \times \{(Vslv - Vdr)/Vslv\} \times \{(Tv - Av)/Tv\}.$$

4. An apparatus according to claim 1, wherein in each of the first image forming station and the second image forming station, the developer carrying member carries the developer so that the developer contacts the image bearing member.

5. An apparatus according to claim 1, wherein in each of the first image forming station and the second image forming station, the density of a second toner image resulting from the development of the second latent image pattern is lower than that of a first toner image resulting from the development of the first latent image pattern, wherein the controller binarizes an output of the toner sensor from the first toner image resulting from the development of the first latent image pattern and an output of the toner sensor from the second toner image resulting from the development of the second latent image pattern on the basis of a threshold which is between these outputs, and determines a center position of the toner image of the range in the first toner image side output of the threshold, and wherein the controller corrects the positions of the toner images formed by the first image forming station and the second image forming station on the basis of the determined center position.

6. An apparatus according to claim 5, wherein in each of the first image forming station and the second image forming station, a latent image potential of the second latent image pattern is lower than that of the first latent image pattern.

7. An image forming apparatus comprising:

a plurality of image forming stations configured to form respective toner images, each of the image forming stations including a rotatable image bearing member, a latent image forming device configured to form an electrostatic latent image on the image bearing member, and a developing device configured to develop the electrostatic latent image formed on the image bearing member, the developing device including a developer carrying member configured to carry a developer comprising toner and a carrier and movable in the same direction at a position where the developer carrying member is opposed to the image bearing member;

a toner sensor configured to detect a toner image for registration correction of images formed by the image forming stations; and a controller capable of executing an operation in a position correction mode for correcting a writing position of the images formed by the image forming stations on the basis of a result of detection of the toner images for the registration correction by the toner sensor, wherein in the operation in the position correction mode, the controller effects the control such that in forming a first latent image pattern which is a latent image for the toner image for the registration correction, a second latent image pattern is formed at an upstream side of the first latent image pattern with respect to a moving direction of the image, the controller controls a formation position of the second latent image pattern such that the toner image resulting from the development of the first latent image pattern has a width, measured in the image moving direction, which is greater than that of the toner image resulting from the development of a latent image pattern alone which is the same as the first latent image pattern, or the toner image resulting from the development of the first latent image pattern has an image density at an upstream end portion with respect to the moving direction, which density is higher than that of the toner image resulting from the development of the latent image pattern alone which is the same as the first latent image pattern, and the controller controls a formation position of the second latent image pattern such that a difference between the width, measured in the image moving direction, of the toner image resulting from the development of the first latent image pattern and a width of the first latent image pattern is not more than 200 μm.

8. An image forming apparatus comprising:

a first image forming station configured to form a toner image and a second image forming station configured to form a toner image, each of the first image forming station and the second image forming station including a rotatable image bearing member, a latent image forming device configured to form an electrostatic latent image on the image bearing member, and a developing device configured to develop the electrostatic latent image formed on the image bearing member, the developing device including a developer carrying member configured to carry a developer comprising toner and a magnetic carrier and movable in the same direction at a position where the developer carrying member is opposed to the image bearing member;

a toner sensor configured to detect a toner image for registration correction of images formed by the first image forming station and the second forming station; and a controller capable of executing an operation in a position correction mode for correcting a writing position of the images formed by the first image forming station and the second forming station on the basis of a result of detection of the toner images for the registration correction by the toner sensor, wherein in the operation in the position correction mode, the controller controls each of the first image forming station and the second image forming station such that in each of the first image forming station and the second image forming station, a first latent image pattern which is a latent image for the toner image for the registration correction and a second latent image pattern are formed such that, in the first image forming station, the first latent image pattern and the second latent image pattern are formed on the same image bearing member of the first image forming station, in the second image forming station, the first latent image pattern and the second latent image pattern are formed on the same image bearing member of the second image forming station, in each of the first image forming station and the second image forming station, the second latent image pattern is formed at least at an upstream side of the first latent image pattern with respect to a moving direction of the image, and in each of the first image forming station and the second image forming station, the second latent image pattern and the first latent image pattern are spaced from each other in a moving direction of the image such that a distance from an upstreammost position of the first latent image pattern and a downstreammost position of the second latent image pattern is not more than 300 μm.

* * * * *